US010054360B2

(12) United States Patent
Kang

(10) Patent No.: US 10,054,360 B2
(45) Date of Patent: Aug. 21, 2018

(54) REFRIGERATOR

(71) Applicant: LG ELECTRONICS INC., Seoul (KR)

(72) Inventor: Daekil Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/348,748

(22) Filed: Nov. 10, 2016

(65) Prior Publication Data

US 2017/0176086 A1 Jun. 22, 2017

(30) Foreign Application Priority Data

Dec. 17, 2015 (KR) ..... 10-2015-0181317

(51) Int. Cl.
*A47B 96/04* (2006.01)
*F25D 23/02* (2006.01)
(Continued)

(52) U.S. Cl.
CPC ..... *F25D 23/025* (2013.01); *E05B 47/0038* (2013.01); *E05C 7/02* (2013.01);
(Continued)

(58) Field of Classification Search
CPC ..... F25D 23/025; F25D 23/028; F25D 11/02; F25D 2323/023; E05B 47/0038; E05C 7/02; E05C 19/163; E05C 19/161
See application file for complete search history.

(56) References Cited

U.S. PATENT DOCUMENTS 1,984,977 A * 12/1934 Mize ..... F25D 23/04 312/276
3,605,459 A * 9/1971 Van Dalen ..... E05L 347/0038 292/144
(Continued)

FOREIGN PATENT DOCUMENTS

JP 2000-249462 9/2000
KR 20-0340005 1/2004
(Continued)

OTHER PUBLICATIONS

International Search Report in International Application No. PCT/KR2016/012942, dated Feb. 13, 2017, 18 pages.

*Primary Examiner* — Hanh V Tran
(74) *Attorney, Agent, or Firm* — Fish & Richardson P.C.

(57) ABSTRACT

A home appliance includes a main body having a storage compartment, a first door hingedly coupled to the main body that opens and closes the storage compartment, and a second door that rotates relative to the first door. The second door includes a latch receptor. The first door includes a locking device with a magnetic component and a latch member. In a state in which the first door closes the storage compartment of the main body, separating the magnetic component from the main body by a first distance, the locking device disengages the latch member from the latch receptor of the second door. In a state in which the first door opens the storage compartment of the main body, separating the magnetic component from the main body by greater than the first distance, the locking device engages the latch member into the latch receptor of the second door.

30 Claims, 6 Drawing Sheets

(51) Int. Cl.

| | |
|---|---|
| ***E05C 19/16*** | (2006.01) |
| ***F25D 11/02*** | (2006.01) |
| ***E05B 47/00*** | (2006.01) |
| ***E05C 7/02*** | (2006.01) |

(52) U.S. Cl.
CPC ..... *E05C 19/163* (2013.01); *F25D 11/02* (2013.01); *F25D 23/028* (2013.01); *E05C 19/161* (2013.01); *F25D 2323/023* (2013.01)

(56) References Cited

U.S. PATENT DOCUMENTS 4,767,139 A * 8/1988 Hansing ..... E05C 7/02 292/150
9,482,463 B2 * 11/2016 Choi ..... F25D 23/04
2011/0083461 A1 * 4/2011 Kim ..... F25D 23/028 62/264
2013/0026900 A1 * 1/2013 Oh ..... F25D 23/02 312/401
2013/0033163 A1 * 2/2013 Kang ..... F25D 23/025 312/405.1
2013/0049562 A1 * 2/2013 Jung ..... F25D 23/028 312/405
2013/0170897 A1 * 7/2013 Kang ..... F25D 23/04 403/321
2014/0232251 A1 * 8/2014 Kim ..... F25D 23/028 312/404
2015/0069900 A1 * 3/2015 Lim ..... F25D 23/028 312/405
2015/0204110 A1 * 7/2015 Boutelegier ..... E05L 347/0012 292/138
2015/0241116 A1 * 8/2015 Choi ..... E05B 65/0042 312/404
2015/0260443 A1 * 9/2015 Lee ..... F25D 23/02 312/404
2015/0260445 A1 * 9/2015 Kim ..... F25D 23/028 312/405
2015/0308158 A1 * 10/2015 Jeon ..... E05B 65/0042 312/405
2016/0061511 A1 * 3/2016 Park ..... F25D 11/02 312/404
2016/0138855 A1 * 5/2016 Choo ..... E05L 347/06 312/405.1
2016/0145917 A1 * 5/2016 Kim ..... E05B 65/0042 312/405
2016/0313050 A1 * 10/2016 Yoon ..... E06L 37/18

FOREIGN PATENT DOCUMENTS

KR 10-2012-0063307 6/2012
KR 10-2015-0056955 5/2015
KR 10-2015-0082065 7/2015

* cited by examiner

REFRIGERATOR

CROSS-REFERENCE TO RELATED APPLICATIONS

Pursuant to 35 U.S.C. § 119(a), this application claims the benefit of an earlier filing date and right of priority to Korean Patent Application No. 10-2015-0181317, filed on Dec. 17, 2015 in the Korean Intellectual Property Office, the disclosure of which is incorporated herein by reference.

TECHNICAL FIELD

The present disclosure relates to a home appliance, and more particularly, to a refrigerator having double doors.

BACKGROUND

Generally, a refrigerator utilizes cold air generated by a freezing cycle configured of a compressor, a condenser, an expansion valve and an evaporator and lowers a temperature therein to freeze or refrigerate foods. A refrigerator typically includes a freezer compartment in which food or beverages are preserved in a frozen state and a refrigerator compartment in which food or beverages are preserved at a low temperature.

Refrigerators are commonly classified into a top-mount type having a freezer compartment mounted on top of a refrigerator compartment, a bottom-freezer type having a freezer compartment mounted below a refrigerator compartment, and a side-by-side type having freezer and refrigerator compartments arranged side-by-side. A door is typically provided in each of the freezer compartment and the refrigerator compartment, and a user may access the freezer compartment and the refrigerator compartment through each door.

In addition to refrigerators in which a freezer compartment and a refrigerator compartment are separately compartmentalized from each other, some refrigerators include a freezer compartment and refrigerator compartment that may be opened or closed by a single door. The latter type of refrigerator is typically a small-scaled refrigerator that generally includes a freezer compartment arranged at a certain space inside the refrigerator compartment.

In addition, a French type refrigerator is a type of top-mount refrigerator having a refrigerator compartment arranged on top of the freezer compartment and opened or closed by French-style double-sided doors. A freezer compartment of a French-type refrigerator may also be opened or closed by the French-style double-sided doors.

Some refrigerators provide various functions in addition to storing food in a refrigerated or frozen state. For example, a dispenser on a door of a refrigerator can supply purified water and ice. In addition, a display on a front surface of the door can display various states of the refrigerator and allow a user to manage the refrigerator.

In addition, some refrigerators include multiple separate storage compartments. For example, some refrigerators include a sub door that opens or closes a sub-storage compartment provided in a main door. The sub-storage compartment is a partial area of a main storage compartment and is separately compartmentalized from the main storage compartment by at least a partial compartment wall. Such refrigerators are often referred to as door-in-door (DID) refrigerators, also referred to as double-door refrigerators. An advantage of such DID refrigerators is that opening the sub-door alone maintains a closed state of the main storage compartment, thus mitigating the escape of cool air from inside the main storage compartment and thereby achieving an energy saving effect.

As an example, the sub-storage compartment may be configured to store frequently accessed items, such as beverages, whereby a user may access the sub-storage compartment by opening the sub-door without opening the main door.

In addition to refrigerators, other types of home appliances are also configured with DID or double-door structures, in which a second door can be opened independently from a first door and rotates relative to the first door.

SUMMARY

In one aspect, a home appliance may include a main body having a storage compartment defined therein; a first door hingedly coupled to the main body and configured to open and close the storage compartment; and a second door rotatably provided relative to the first door and comprising a latch receptor. The home appliance may also include a locking device that is disposed in the first door and that includes a magnetic component and a latch member. The locking device may be configured to: in a state in which the first door closes the storage compartment of the main body and the magnetic component is separated from the main body by a first distance, disengage the latch member from the latch receptor of the second door; and in a state in which the first door opens the storage compartment of the main body and the magnetic component is separated from the main body by greater than the first distance, engage the latch member into the latch receptor of the second door.

In some implementations, the locking device may further include a moving member that connects the magnetic component with the latch member. The moving member may be configured to: in the state in which the first door closes the storage compartment of the main body and the magnetic component is separated from the main body by a first distance, apply a first displacement force to the latch member that disengages the latch member from the latch receptor of the second door, and in the state in which the first door opens the storage compartment of the main body and the magnetic component is separated from the main body by greater than the first distance, apply a second displacement force to the latch member that engages the latch member into the latch receptor of the second door.

In some implementations, the locking device may further include an elastic member coupled to the moving member and configured to: apply, to the moving member, an elastic restoring force that causes the moving member to exert the second displacement force to the latch member that engages the latch member into the latch receptor of the second door.

In some implementations, in the state in which the first door closes the storage compartment of the main body and the magnetic component is separated from the main body by the first distance: a magnetic attractive force between the magnetic component and the main body may displace the moving member in a first direction that is opposite to a second direction in which the moving member is pulled by the elastic restoring force applied by the elastic member. In the state in which the first door opens the storage compartment of the main body and the magnetic component is separated from the main body by a second distance greater than the first distance: the elastic restoring force applied by the elastic member on the moving member may displace the moving member in the second direction that is opposite to the first direction in which the moving member is pulled by the magnetic attractive force between the magnetic component and the main body.

In some implementations, the second door may include a sidewall portion in which the latch receptor is disposed, the first door may further include a door frame that defines an opening through the first door, and at least a part of the sidewall portion of the second door may be provided in a partially inserted position within the opening of the door frame.

In some implementations, the locking device in the first door may be configured to engage the latch member with the latch receptor of the second door by extending the latch member to protrude outward from the door frame of the first door and become inserted into the latch receptor of the second door. The locking device in the first door may be configured to disengage the latch member from the latch receptor of the second door by retracting the latch member within the door frame of the first door and become removed from within the latch receptor of the second door.

In some implementations, the main body may include a magnetic portion configured to generate the magnetic attractive force with the magnetic component of the locking device, wherein at least one of the magnetic portion of the main body or the magnetic component of the moving member may be a magnet.

In some implementations, the locking device may further include a displacement transfer member provided between the moving member and the latch member. The displacement transfer member may be configured to: based on a displacement of the moving member, apply a corresponding displacement to the latch member.

In some implementations, the displacement transfer member may include: a first inclined portion provided in the moving member; and a second inclined portion provided in the latch member, the second inclined portion configured to slide relative to the first inclined portion.

In some implementations, the second inclined portion may include an inclined hole through which the first inclined portion is configured to be inserted at an angle.

In some implementations, the second inclined portion may be configured to slide relative to the first inclined portion according to the displacement of the moving member. The latch member may be configured to be displaced along a vertical direction that is perpendicular to a direction along which the moving member is displaced.

In some implementations, the locking device may include a housing configured to receive the moving member and the latch member therein. The housing may be configured to guide a movement of the moving member and a movement of the latch member.

In some implementations, the housing may include a first penetrator through which at least a part of the latch member protrudes from or retracts within.

In some implementations, the housing may further include a second penetrator configured to restrict a magnetic portion of the main body from approaching the magnetic component of the moving member by less than a minimum distance.

In some implementations, the moving member may include an inclined compensator configured to compensate for a height difference between the magnetic component of the locking device and the latch member.

In some implementations, the latch member may include an inclined surface formed at an end portion of the latch member that is inserted into the latch receptor, the inclined surface facing towards a front of the first door and having a slope that recedes towards a rear of the first door along a downward direction.

In some implementations, the main body may further include a pillar bracket, and the magnetic portion of the main body may be provided in the pillar bracket.

In some implementations, the locking device may be provided on a first side end portion of the first door that is opposite to a second side end portion of the first door on which the first door is hingedly coupled to the main body.

In some implementations, the home appliance may be a refrigerator.

In another aspect, a home appliance may include a main body having a storage compartment defined therein; a first door hingedly coupled to the main body and configured to open and close the storage compartment; and a second door rotatably provided relative to the first door. The home appliance may also include a locking device disposed in the first door and configured to: in a state in which the first door opens the storage compartment of the main body, engage a locked state between the first door and the second door that restricts an opening operation of the second door relative to the first door; and in a state in which the first door closes the storage compartment of the main body, disengage the locked state between the first door and the second door.

In some implementations, the locking device may further include a magnetic component and may be configured to: engage the locked state between the first door and the second door based on the magnetic component and the main body being separated by a first distance, and disengage the locked state between the first door and the second door based on the magnetic component and the main body being separated by greater than the first distance.

In some implementations, the second door may include a latch receptor; and the locking device in the first door may further include a latch member. The locking device may further be configured to: insert the latch member into the latch receptor of the second door in the state in which the first door opens the storage compartment of the main body; and retract the latch member out of the latch receptor of the second door in the state in which the first door closes the storage compartment of the main body.

In some implementations, the locking device in the first door may further include a moving member. The locking device may further be configured to: in the state in which the first door opens the storage compartment of the main body, displace the moving member in a first direction towards a front of the first door such that the moving member applies a first force on the latch member inserting the latch member into the latch receptor of the second door; and in the state in which the first door closes the storage compartment of the main body, displace the moving member in a second direction towards a rear of the first door such that moving member applies a second force on the latch member retracting the latch member out of the latch receptor of the second door.

In some implementations, the locking device may further include a housing configured to receive the moving member and the latch member therein, the housing being fully encased within the first door.

In some implementations, the housing may be arranged inside the first door, within an upper side of the first door.

In some implementations, the latch member may include an end portion that is selectively exposed outside of the first door, an exposed part of the end portion being reduced by a rearward displacement of the moving member and being increased by a forward displacement of the moving member.

In some implementations, the locking device may further include a displacement transfer member provided between the moving member and the latch member. The displacement transfer member may be configured to: based on a displacement of the moving member, apply a corresponding displacement to the latch member.

In some implementations, the moving member may include the magnetic component provided at an end portion of the moving member.

In some implementations, the locking device may further include an elastic member configured to apply an elastic restoring force to the moving member in a first direction that is opposite to a second direction in which the moving member is pulled by a magnetic attraction between the magnetic component and the main body.

In some implementations, the main body may include a pillar; and a magnetic portion configured to generate the magnetic attraction with the magnetic component of the locking device, the magnetic portion configured to move in a rearward direction and fold the pillar in the state in which the first door opens the storage compartment of the main body.

It is to be understood that both the foregoing general description and the following detailed description are exemplary and explanatory and are intended to provide further explanation of the subject matter claimed.

DETAILED DESCRIPTION

Systems and techniques are described herein that enable a DID or double-door home appliance providing a locking device that selectively engages a locked state between a first door and a second door based on whether the first door is open or closed. In some implementations, the first door may be configured to rotate relative to a main body of the home appliance. In the unlocked state, the second door may be configured to rotate relative to both the main body and the first door. The home appliance may maintain a locked state between the first door and the second door in a state in which the first door is open relative to the main body, thus restricting the second door from detaching from the first door. Conversely, the home appliance may disengage the locked state between the first door and the second door when the first door is closed, thus allowing the second door to be opened separately from the first door.

Figure 1:
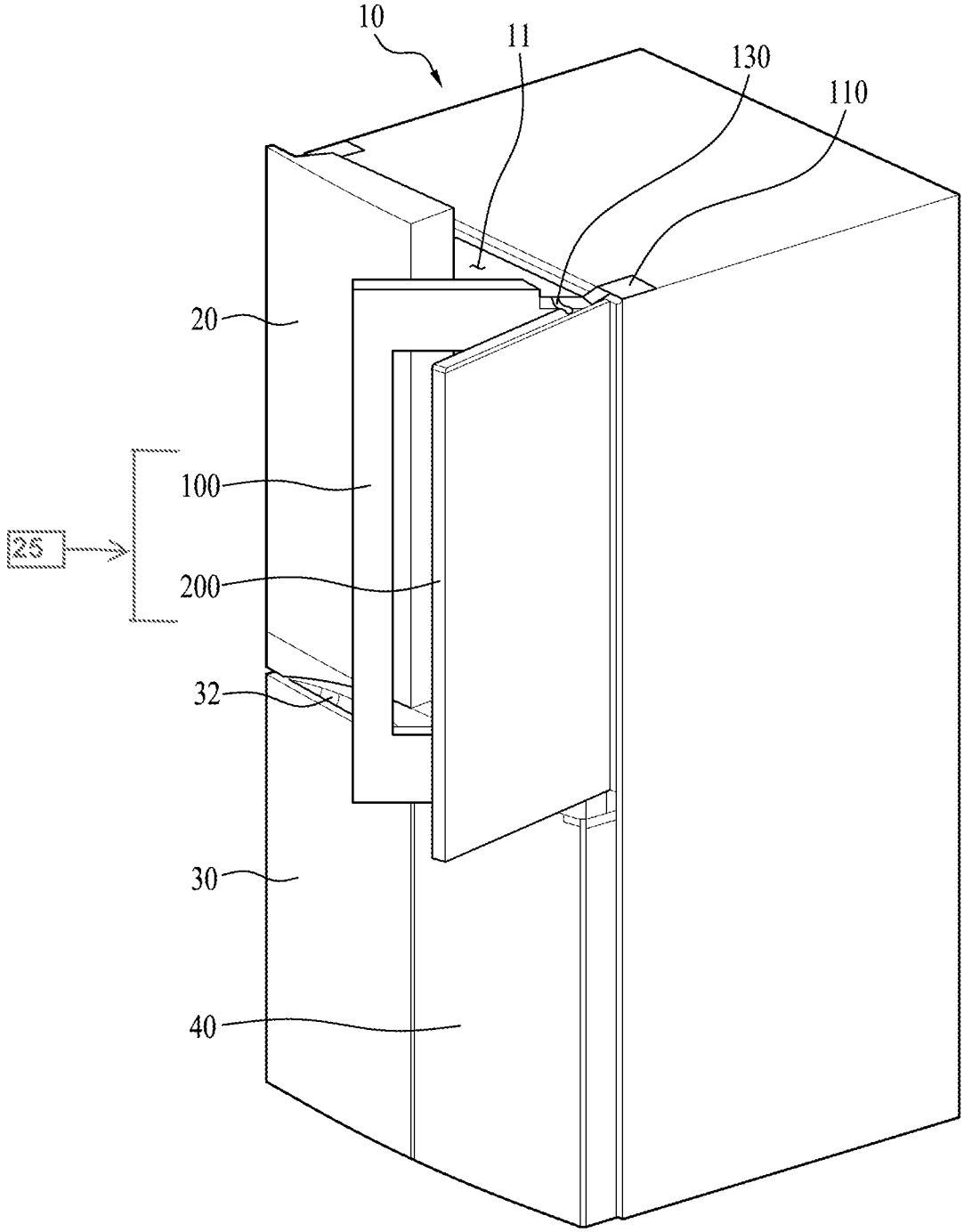
FIG. 1 is a diagram illustrating an example of a double-door refrigerator or DID door refrigerator.

FIG. 1 illustrates an example of a DID refrigerator or a double-door refrigerator. The refrigerator shown in FIG. 1 is a bottom-freezer type refrigerator in which a refrigerator compartment is provided on an upper portion of a main body 10 and a freezer compartment is provided on a lower portion of the main body 10. The refrigerator compartment and the freezer compartment may be a part of either a storage compartment provided in the main body 10 or a main storage compartment 11.

In the example of FIG. 1, a left refrigerator compartment door 20 and a right refrigerator compartment door 25 are rotatably mounted at left and right sides of the main body 10 as doors for opening or closing the refrigerator compartment.

Freezer compartment doors provided below the refrigerator compartment doors may include a left freezer compartment door 30 and a right freezer compartment door 40, which are rotatably mounted at both sides of a lower portion of a front surface of the main body 10. Alternatively, a single freezer compartment door may rotatably be mounted or a drawer-type door configured to be ejected or injected in a forward or backward direction may be mounted as the freezer compartment door.

A handle groove 32 may be provided on an upper surface of the left freezer compartment door 30, and a handle groove may also be provided on an upper surface of the right freezer compartment door 40.

As shown in FIG. 1, the right refrigerator compartment door 25 may include a main door 100 rotatably mounted at one side of the main body 10 by a main door hinge 110 and a sub-door 200 rotatably mounted at the main door 100 or the main body 10 by a sub-door hinge 130. As such, if a user opens the main door 100 and the sub-door 200 together, the user may access the interior of the refrigerator.

An opening may be provided through a center portion of the main door 100, and a sub-storage compartment may be provided at a rear side of the main door 100.

If the user opens the sub-door 200, the user may access the sub-storage compartment through the opening of the main door 100. As such, the user may access the sub-storage compartment by opening the sub-door 200 without opening the main door 100.

As shown in the example of FIG. 1, the DID refrigerator or double-door refrigerator may have a structure that the sub-door 200 is superimposed on the main door 100. As such, the DID refrigerator or double-door refrigerator may have a structure that the sub-door 200 covers the front surface of the main door 100, wherein a front surface area of the main door 100 may be substantially the same as that of the sub-door 200.

A user may use such a refrigerator by accessing the main storage compartment 11 by opening the main door 100 and the sub door 200 together, or by accessing the sub-storage compartment by opening the sub door 200 only.

In this type of refrigerator, when both the main door 100 and the sub door 200 are in an open state, if a user closes the main door 100, then a problem may occur in that the main door 100 and the sub door 200 may become detached from each other by inertia.

For example, as shown in FIG. 1, if a user closes the main door 100 in a state in which both the main door 100 and the sub-door 200 are open, then a problem may occur in that the sub-door 200 becomes detached from the main door 100. This may cause only the main door 100 to be closed while the sub-door 200 remains open. Such a scenario may cause inconvenience or harm for a user. For example, as a user closes the main door 100 and the sub-door 200, the user may naturally move in a direction towards the refrigerator to complete the closing operation. However, if the sub-door 200 becomes detached from the main door 100 during the closing operation, then the sub-door 200 may remain open while the user closes the main door 100, thereby causing the user to collide with the open sub-door 200. A user may not consider a relative rotation of the sub-door 200 with respect to the main door 100, thereby causing the user to manipulate only the main door 100 during the closing operation and cause the sub-door 200 to become detached from the main door 100.

In another scenario, if the user opens the main door 100 and then suddenly stops the opening motion, then a problem may occur in that the main door 100 may come to a stop, but the sub-door 200 may become detached from the main door 100 by inertia, causing the sub-door 200 to continue to rotate in an opening direction. This may cause the sub-door 200 to continue opening in an unimpeded manner, creating a risk that the contents of the sub-door 200 may become damaged.

As a specific example, as shown in FIG. 1, such problems may be exacerbated if the rotational arc of the main door 100 is substantially the same as the rotational arc of the sub door 200, for example of the main door 100 and the sub-door 200 are of similar size. In such scenarios, there may be increased risk of the user colliding with the sub-door 200, or increased risk of the sub-door 200 continuing to open with high inertia, if the sub-door 200 becomes detached from the main door 100.

To address such problems, a locking device may be provided that selectively maintains a locked state between the main door 100 and the sub-door 200. For example, the locking device may be configured to maintain a locked state between the main door 100 and the sub-door 200 if the main door 100 is in an open state, and otherwise detach the sub-door 200 from the main door 100 if the main door 100 is closed.

However, there are numerous challenges to providing such a locking device in view of properties of refrigerator doors. For example, doors of a refrigerator are typically provided on the front surface of the refrigerator, and it is generally not preferable that the locking device is exposed outside the refrigerator, in view of a design aspect of the refrigerator. Even if the locking device is externally exposed, then a separate space would typically be required to accommodate the locking device, and furthermore a problem may occur in that the locking device may not be operated normally due to external impact or external obstructions.

Moreover, because the locking device is a safety element, it may be preferable to prevent the locking device from being exposed to a user who may, whether intentionally or accidentally, manipulate the locking and unlocking functionality. As such, there may be numerous reasons to configure the locking device to perform its functionality while not being exposed to the user. Instead, it may be preferable that the locking device not be exposed visually outside the refrigerator, especially outside the main door 100 or the sub-door 200.

As another challenge, the doors of a refrigerator are typically insulated to perform an insulation function for maintaining cool air inside the refrigerator. Therefore, it is preferable that such an insulation function is not deteriorated due to the presence and operation of a locking device.

In view of such challenges, a DID refrigerator or double-door refrigerator should satisfy a design element in appearance, maintain an insulation function of its doors, ensure reliability of a locking device, and ensure reliable interworking between the locking device and the refrigerator doors.

Implementations are described herein that enable a refrigerator that selectively engages a locked state between a second door and a first door. As such, the refrigerator may help prevent a second door from being detached from a first door when the first door is closed and/or when the first door is rapidly stopped after being opened.

Such a refrigerator may prevent an aesthetic design element from being damaged by a locking device. For example, the refrigerator may have a safe and aesthetic design by allowing a locking device and its operation to be unexposed to a user.

In accordance with some implementations, a refrigerator may be configured to identify a closed state and an opened state of a first door easily and mechanically. As such, the refrigerator may be provided with a locking device that is configured to operate in a simple and reliable manner.

In accordance with some implementations, a refrigerator may avoid damage caused by a locking device to a sealing force between a first door and a main body through a door gasket.

In accordance with some implementations, a refrigerator may minimize deterioration of insulation performance of a first door and a second door caused by a locking device. Moreover, the refrigerator may help prevent a structure of a first door and a second door from being complicated by a locking device.

In accordance with some implementations, a refrigerator may be provided with a moving member arranged inside a first door that is configured to minimize an influence of external interference when the moving member moves during an operation of the locking device.

In accordance with some implementations, a refrigerator may be provided in which a moving mechanism of a moving member may be realized in a simple manner by using a magnetic force in a door-in-door refrigerator in which a second door is closed by being inserted into a door frame of a first door.

In accordance with some implementations, a refrigerator may reduce impact applied to a locking device and may easily be switched to a rotation-restricted state of a second door when only the second door is closed in a state in which both a first door and the second door are open.

In accordance with some implementations, a refrigerator may be provided in which a closed or opened state of a first door may immediately be transferred to an operation of a locking device.

In accordance with some implementations, a refrigerator may be provided in which a pillar structure and a structure of a locking device are configured using a magnetic force to enhance reliability in functions of the pillar and the locking device.

Hereinafter, for convenience of description, a user direction based on a front surface of a refrigerator will be referred to as a forward direction, and a direction of a rear surface of a refrigerator will be referred to as a backward direction.

Figure 2:
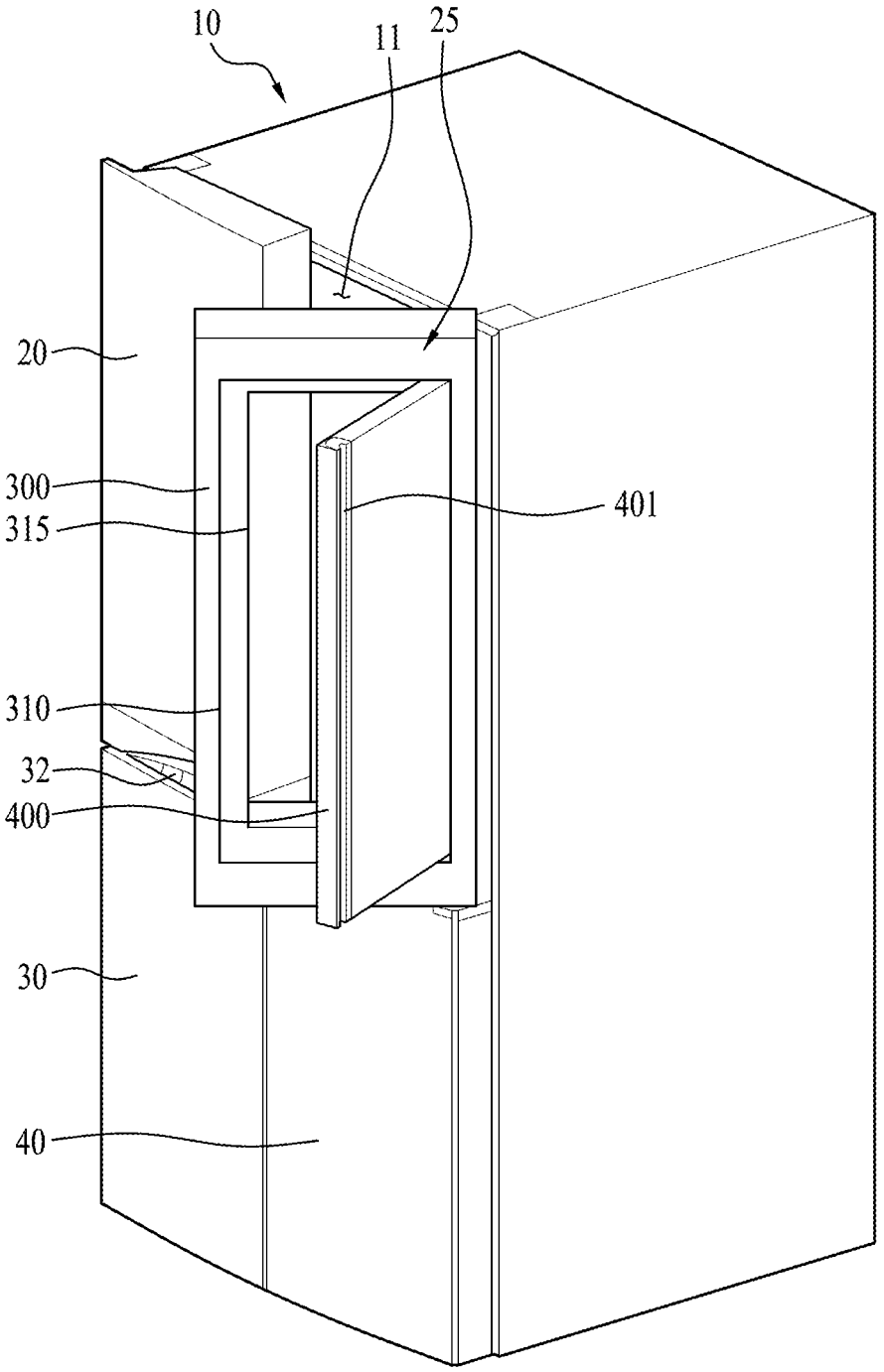
FIG. 2 is a diagram illustrating an example of a refrigerator according to some implementations.

FIG. 2 illustrates an example of a refrigerator according to one implementation. Implementations, however, are not limited to the example in FIG. 2 and may be applied to various types of refrigerators, such as a side-by-side refrigerator, a refrigerator having one door, or a refrigerator having a sub-door rotatable with respect to a main door. Implementations may also be applied to an outside-type DID refrigerator shown in FIG. 1. As such, implementations may generally be applied to a refrigerator having a first door that is independently rotatable with respect to a first door.

As shown in the example of FIG. 2, a right refrigerator compartment door 25 may include a first door 300, for example a main door, that is rotatably mounted in a main body 10 and provided with an opening 310 at the center of an inner side of the first door 300. In addition, the right refrigerator compartment door 25 may include a second door 400, for example a sub door, inserted into the opening 310 of the first door 300 and rotatably mounted.

In the refrigerator according to this example, the second door 400 is formed to be smaller than the first door 300 and inserted into the opening 310 of the first door 300 when closed. As such, at least a part of the second door 400 based on a front and rear width is received in the first door 300, and thus at least a part of a side of the second door 400 may be inserted into the opening 310 of the first door 300.

The refrigerator according to the example of FIG. 2 in which the second door 400 is closed by being inserted into the first door 300 in a state that the first door 300 is closed may be referred to as an inside-type DID refrigerator or inside-type double-door refrigerator. Implementations, however, are not limited thereto and may also be applied to other types of refrigerators, such as an outside-type DID refrigerator shown in FIG. 1.

Figure 3:
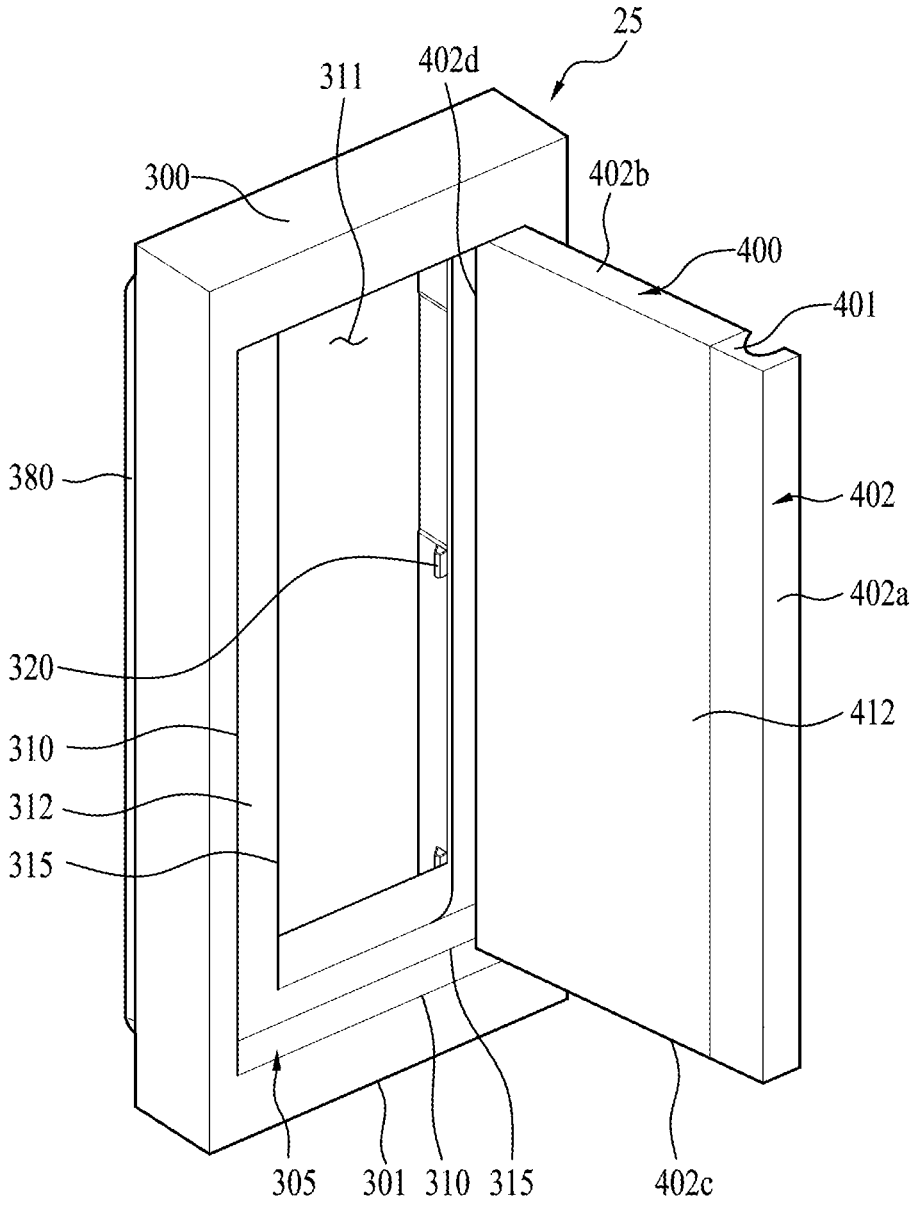
FIG. 3 is a diagram illustrating examples of a first door and a second door of a refrigerator

FIG. 3 illustrates an example of a first door and a second door, such as those shown in FIG. 2.

An opening 315 may be provided at an inner side of the center of the first door 300, and a sub-storage compartment 311 may be provided at a rear side of the first door 300. As such, the opening 310 into which the sub-door 400 is inserted and the opening 315 for accessing the sub-storage compartment 311 may respectively be formed in the first door 300. The opening 315 may be formed at an inner side within a circumference of the opening 310.

A gasket 380 of the first door 300 may be provided at an edge portion on a rear surface of the first door 300. As such, cool air between the first door 300 and a storage compartment inside the main body is sealed through the gasket 380.

A plane portion that enables sealing may be formed between the two openings 310 and 315, and may be referred to as a gasket sealing portion 312. The gasket sealing portion 312 corresponds to a gasket sealing portion 412 formed in the first door 300.

The two gasket sealing portions 412 and 312 correspond to each other, and a gasket may be provided in any one of the two gasket sealing portions 412 or 312. Therefore, sealing between the first door 300 and the second door 400 may be made through the gasket sealing portions 412 and 312. As such, in some implementations, the sub-storage compartment 311 may be substantially arranged at an inner side of a circumference of the gasket sealing portions 412 and 312.

If a user opens the second door 400, the user may access the sub-storage compartment 311 through the opening 315 of the first door 300. As such, the user may access the sub-storage compartment 311 by opening only the second door 400 without opening the first door 300.

The sub-storage compartment 311 may be formed in such a manner that a plurality of baskets are mounted up-and-down along the compartment. In some implementations, a cover may be provided that covers the plurality of baskets. The cover may serve as a compartment wall that comparts the sub-storage compartment 311 from a main storage compartment 11. As such, the sub-storage compartment may be arranged at the front portion of the main storage compartment 11.

As shown in the example of FIG. 3, a mounting protrusion 320 may be configured to mount the plurality of baskets and may be provided at an inner side in a backward direction of the opening 315 of the second door 400. Any suitable number of pairs, for example two or three pairs, of baskets may be mounted up and down to be spaced apart from one another at predetermined intervals. Therefore, as shown in FIG. 3, a user may access the sub-storage compartment 311 by opening the second door 400 in a state in which the first door 300 is closed.

As an example, a door frame 305 is provided in the first door 300. In some implementations, the first door 300 itself may form the door frame 305. The opening 310 may be formed in the door frame 305. If the second door 400 is received in the door frame 305, then the second door 400 may be considered to be in a closed state. Conversely, if the second door 400 is substantially detached from the door frame 305, then the second door 400 may be considered to be in an opened state. The opened state of the second door 400 is shown in the example of FIG. 3.

The second door 400 may be provided with a handle 401. A user may open or close the second door 400 by holding the handle 401. In addition, the first door 300 may be provided with a handle 301. In some implementations, the handle 301 of the first door 300 may be provided outside of the door frame 305. For example, the first door handle 301 may be formed outside a side or a lower surface of the door frame 305. Various shapes or types may be implemented for each of the handles 301 and 401. In some implementations, the handles 301 and 401 are provided separately from each other.

As an example, the handle 301 of the first door 300 and the handle 401 of the second door 400 may be provided separately from each other to allow the first door handle 301 to open or close the first door 300 and allow the second door handle 401 to open or close the second door 400.

When opening the first door 300, a user opens the first door 300 by holding the handle 301 of the first door 300. The user opens the first door 300 by overcoming a magnetic force generated between the first door 300 and the main body 10. The magnetic force may, for example, be generated by a rubber magnet gasket. Likewise, when opening the second door 400, the user opens the second door 400 by holding the handle 401 of the second door 400 and overcoming a magnetic force generated by a rubber magnet gasket.

Therefore, in a state in which the first door 300 is closed, the second door 400 may be opened by overcoming the magnetic force of the rubber magnet gasket, which is generated between the first door 300 and the second door 400. However, such rubber magnet gaskets may be insufficient to prevent a problem in which the second door 400 becomes detached from the first door 300 during opening or closing operations.

For example, if the first door 300 is closed in a state that the first door 300 and the second door 400 are both open, then the standstill inertia of the second door 400 may exceed a magnetic force or sealing force between the first door 300 and the second door 400. This may cause a problem in which the first door 300 becomes detached from the second door 400 during the closing operation. Likewise, if the first door 300 is opened and then stopped, then movement inertia of the second door 400 may exceed a magnetic force or sealing force between the first door 300 and the second door 400. This may cause a problem in which the second door 400 becomes detached from the first door 300 and continues in an opening motion.

To address such problems, implementations are described herein in which a refrigerator includes a locking device 500 that selectively maintains a locked state between the second door 400 and the first door 300. As such, the locking device 500 may be configured to selectively restrict a rotation of the second door 400 with respect to the first door 300.

As an example, the locking device 500 may be configured to allow a rotation of the second door 400 with respect to the first door 300 when the first door 300 is in a closed state, and to restrict a rotation of the second door 400 with respect to the first door 300 when the first door 300 is in an opened state. As such, the locking device 500 may lock the second door 400 to the first door 300 during an opening and/or closing operation of the first door 300, thereby preventing the second door 400 from becoming detached from the first door 300.

If a user opens the second door 400 while the first door 300 is in a closed state, then the user may open only the second door 400 by holding the handle 401 of the second door 400. During this operation, the locking device 500 may release the lock between the second door 400 and the first door 300, thereby allowing the user to open the second door 400.

Conversely, when the first door 300 is in an opened state, the locking device 500 may maintain a locking state between the first door 300 and the second door 400. As such, the second door 400 may be prevented from being detached from the first door 300 as the first door 300 rotates during a closing operation.

In the examples of FIGS. 2 and 3, the rotational directions of the first door 300 and the second door 400 are the same during an opening or closing operation. For example, each of the first door 300 and second door 400 shown in FIG. 2 may be configured to rotate based on a vertical rotational shaft provided at a right side of the doors. The first door 300 may be provided to be rotated by a rotational shaft with respect to the main body 10, and the second door 400 may be provided to be rotated by a rotational shaft with respect to the main body 10 or the first door 300. Due to the rotational direction relation of the first door 300 and the second door 400, a problem may occur in which the second door 400 may be detached from the first door 300 by inertia when the first door 300 is closed or opened.

Figure 4:
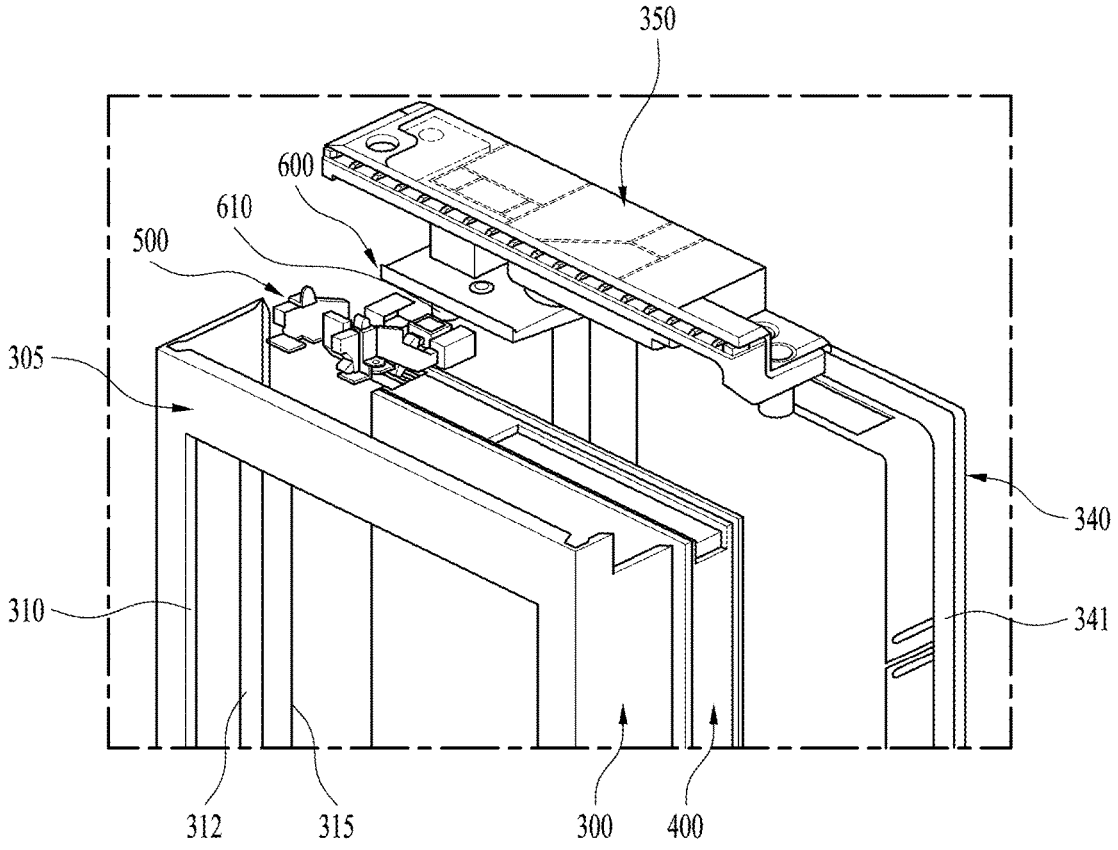
FIG. 4 is a diagram illustrating an exploded view of examples of a first door, a second door and a locking device.

Hereinafter, an example of positional and operational relationships between the locking device 500, the first door 300, and the second door 400 according to some implementations will be described in detail with reference to FIG. 4.

Although the examples shown in FIGS. 4-7 illustrate the locking device 500 provided at an upper end of the first door 300, implementations are not limited thereto. For example, in some implementations, the locking device 500 may be provided at a lower end of the first door 300 by an analogous implementation, with upper and downward operational directions being reversed.

The first door 300 may include a door frame 305 and a door dike 340. The door dike 340 forms a door rear surface and may be referred to as a door liner. The door frame 305 forms a front surface portion of the first door 300, and the door dike 340 forms a rear surface portion of the first door 300. The door frame 305 and the door dike 340 are coupled with each other, and a foaming agent may be filled between the door frame 305 and the door dike 340.

The door frame 305 may substantially form both sides of the first door 300.

In some implementations, the first door 300 may include upper and lower portions, such as a door deco 350, provided on upper and lower ends of the first door 300. For example, the door deco 350 may form each of an upper side and a lower side of the first door 300.

The second door 400 may be configured to rotate with respect to the first door 300. In the example of FIGS. 2 to 4, the second door 400 is provided to be inserted into the opening 310 of the first door 300. However, implementations are not limited thereto, and as shown in the example of FIG. 1, the second door 400 may be configured to be superimposed on the front surface of the first door 300 in some implementations.

The locking device 500 may be arranged inside the first door 300. For example, the locking device 500 may be arranged between the door frame 305 and the door dike 340. The locking device 500 may be arranged above or below the first door 300, and may be arranged at a left side or right side of the first door 300. The position of the locking device 500 may be arranged to correspond to a position of a magnetic substance or magnet on the main body. In some implementations, the locking device 500 is arranged above the first door 300 to correspond to the pillar structure. In general, the locking device 500 may be substantially arranged inside the first door 300.

In some implementations, the locking device 500 may be arranged inside the first door 300 by being covered by the door deco 350. For example, the locking device 500 may be covered by the door deco 350 that forms the upper side of the first door 300. As such, the locking device 500 may be substantially unexposed from the outside of the first door 300. However, implementations are not limited thereto, and the locking device 500 may be arranged inside any suitable structure of the first door 300 so as to be unexposed to the outside.

In some implementations, a gasket slot 341 is configured to mount the gasket 380 and may be provided at the edge of the door dike 340. In a state in which the first door 300 is closed, at least a part of inner side portions in a radius direction of the gasket slot 341 is inserted into the storage compartment inside the main body 10.

The main body 10 may be provided with a magnetic substance 610. The magnetic substance 610 may be, for example, a magnet.

The magnetic substance 610 may be mounted in the main body 10 through a bracket 600. For example, the bracket 600 may be arranged inside the storage compartment of the main body 10. In some implementations, the bracket 600 may be mounted in an upper wall inside the storage compartment of the main body 10. The bracket 600 may be a pillar bracket that forms a pillar structure. The magnetic substance 610 may be provided in the pillar bracket.

The locking device 500 may be configured to operate using attraction generated by the magnetic force. For example, the locking device 500 may include a mechanism that is moved by a magnetic force caused by the magnetic substance 610 provided in the main body 10.

Figure 5:
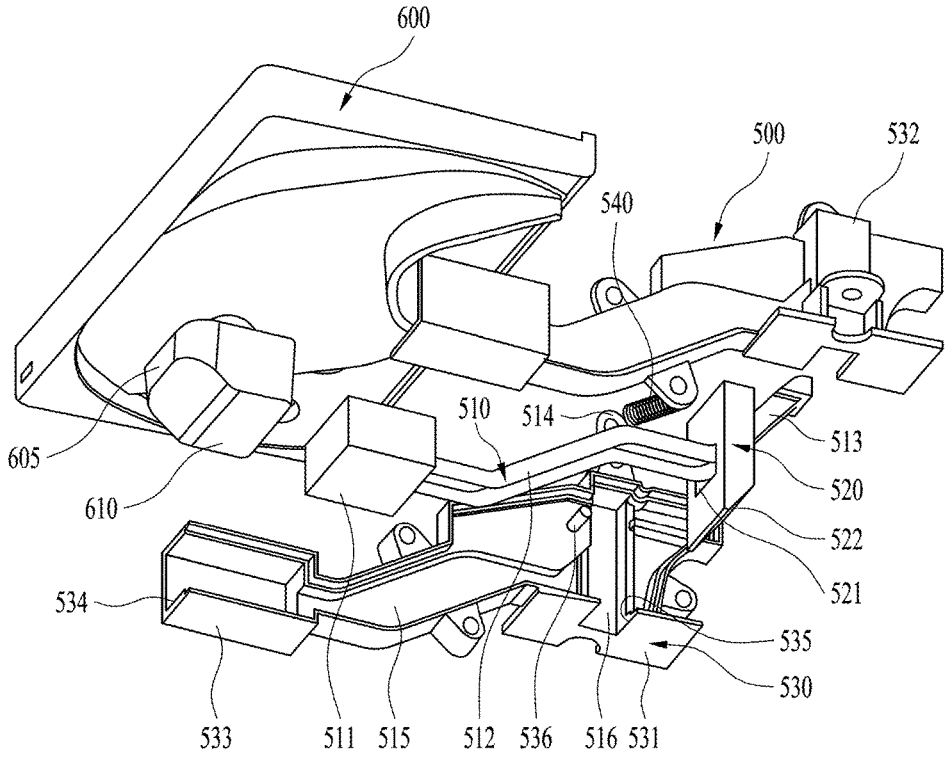
FIG. 5 is a diagram illustrating an exploded view of examples of a main body magnet and a locking device.

For example, the locking device 500 may be provided with a magnetic substance, such as magnetic substance 511 in FIG. 5, that is magnetically attracted to the magnetic substance 610 provided in the main body 10. In this case, the two magnetic substances 610 and 511 may be configured so as not be in contact with each other. As such, by preventing physical contact between the two magnetic substances, the locking device 500 may be configured to operate in a more reliable manner.

Hereinafter, an example of the structure of the locking device 500 will be described in more detail with reference to FIG. 5.

The locking device 500 may include a moving member 510 that selectively engages a locked state between the second door 400 and the first door 300. In the example of FIG. 5, the movements of the moving member 510 are controlled by the magnetic attraction between the magnetic substance 610 provided on main body 10 of the refrigerator and magnetic substance 511 provided on the locking device 500. As such, the magnetic attraction between the magnetic substances 610 and 511 controls the movements of the moving member 510, which in turn controls the locked state between the first door 300 from the second door 400.

For example, when the magnetic substances 610 and 511 are strongly attracted to each other, then this attraction may cause the moving member 510 to be displaced in a manner that causes the first door 300 to be unlocked from the second door 400. This scenario occurs when the magnetic substances 610 and 511 are in close proximity to each other, such as when the first door 300 is in a closed state with the main body 10 of the refrigerator.

Conversely, when the magnetic substances 610 and 511 are weakly attracted to each other, then this weak attraction may allow the moving member 510 to be displaced in another manner that causes the first door 300 to be locked with the second door 400. This scenario occurs when the magnetic substances 610 and 511 are far away from each other, such as when the first door 300 is in an open state and away from the main body 10 of the refrigerator.

As such, the moving member 510 may be controller to have different displacements depending on a variation of the magnetic force between magnetic substances 610 and 511.

In the example of FIG. 5, the moving member 510 includes the magnetic substance 511. In some implementations, the moving member 510 is provided with the magnetic substance 511 that magnetically attracts the magnetic substance 610 provided on the main body 10 of the refrigerator. For example, at least one of the two magnetic substances 511 and 610 may be a magnet. In some implementations, the two magnetic substances 511 and 610 are both magnets thus increasing their magnetic attraction. In some implementations, the magnet is preferably neodymium magnet.

The refrigerator may be configured such that the distance between the two magnetic substances 511 and 610 is at least a minimum distance in a state in which the first door 300 is closed and a maximum magnetic attraction is generated. In such a state, the magnetic substance 511 of the moving member 510 is pulled in a direction towards the magnetic substance 610 of the main body. As such, the magnetic substance 511 of the moving member 510 moves towards a rear of the refrigerator.

In this case, the moving member 510 is arranged at a first position due to the magnetic force generated with the magnetic substance 610 of the main body. This corresponds to the state in which the first door 300 is closed.

When the first door 300 is in an open state, the magnetic force between the moving member 510 and the main body is weakened or removed. This is because the distance between the two magnetic substances 511 and 610 is increased as the first door 300 moves away from the main body of the refrigerator. As such, the magnetic substance 610 of the main body does not generate sufficient pulling magnetic force on the moving member 510.

The locking device 500 may also include an elastic member, for example elastic member 540 in FIG. 5 that pulls the moving member 510 in an opposite direction from the magnetic substance 511. As such, if the magnetic force between the two magnetic substances 511 and 610 is removed, the elastic member 540 pulls the moving member 510 to a second position. In this case, the second position of the moving member 510 corresponds to a state in which the first door 300 is opened.

Therefore, as the first door 300 rotates from a closed to an open state, the moving member 510 is displaced from the first position, where it is pulled by magnetic attraction between the two magnetic substances 511 and 610, to the second position, where it is pulled in an opposite direction by the elastic member 540. As such, the position of the moving member 510 is controlled by whether the first door 300 is in an open state or a closed state.

In turn, this varying displacement of the moving member 510 causes a selective engagement of a locked state between the second door 400 and the first door 300. For example, when the first door 300 is closed relative to the main body, the corresponding first position of the moving member 510 may disengage a locked state between the second door 400 and the first door 300, thus allowing the second door 400 to be opened separately. Conversely, when the first door 300 is open relative to the main body, the corresponding second position of the moving member 510 may engage the locking state between the second door 400 and the first door 300, thus restricting the second door 400 from being opened separately.

As an example of how this may be implemented, as the moving member 510 moves between the first position and the second position, the moving member 510 may cause a corresponding displacement of a latched member 520 in the locking device 500.

For example, if the moving member 510 moves forward towards a front of the first door 300 and opposite to the magnetic substance 511, the latched member 520 may move in an upward direction. If the moving member 510 moves backward towards the rear of the first door 300 and towards the magnetic substance 511, the latched member 520 may move in a downward direction.

This upward and downward translation of the latched member 520 may be implemented, for example, by displacement transfer members, such as a first inclined portion 513 and a second inclined portion 521. The first and second inclined portions 513 and 521 may be configured to transfer a displacement of the moving member 510 to a displacement of the latched member 520.

In some implementations, the first and second inclined portions 513 and 521 may be provided separately from the moving member 510 and the latched member 520. However, implementations are not limited thereto, and in some implementations, the first and second inclined portions 513 and 521 may be formed using a part of the moving member 510 and the latched member 520.

As an example, the moving member 510 may include the first inclined portion 513, and the latched member 520 may be provided with the second inclined portion 521. In some implementations, the first inclined portion 513 may be configured to pass through and slide with respect to the second inclined portion 521.

Figure 6:
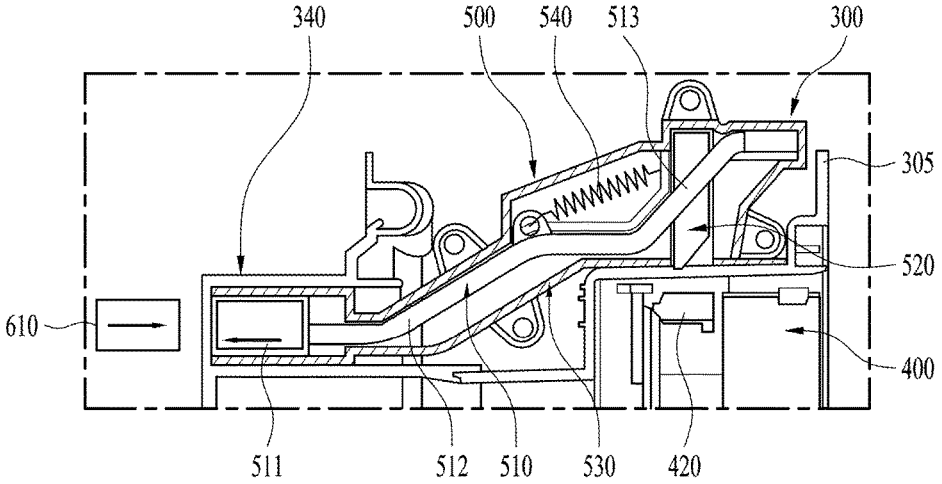
FIG. 6 is a diagram illustrating examples of a locking device configured to, in a state in which the first door is closed, release a locking that restricts a rotation of a second door relative to a first door.

In the examples of FIGS. 5 and 6, the second inclined portion 521 is a hole having an inclined upper and lower surface, through which the first inclined portion 513 passes in a slanted angle. During operation, as shown in FIGS. 5 and 6, if the first inclined portion 513 moves backward towards the magnetic substance 511, then this pushes the latched member 520 in an upwards direction. Conversely, if the first inclined portion 513 moves forward opposite to the magnetic substance 511, then this pushes the latched member 520 in a downward direction.

As such, in the example of FIGS. 5 and 6, a horizontal displacement of the moving member 510 may generate a vertical displacement of the latched member 520.

For example, as the moving member 510 horizontally moves between the first position and second position caused by the opening and closing of the first door 300, this may cause the latched member 520 to move between two different vertical positions. The two different vertical positions of the latched member 520 may correspond to a locked and unlocked state of the locking device 500, which determines whether the second door 400 is restricted from being opened relative to the first door 300.

In the examples of FIGS. 5 and 6, the first position of the moving member 510 corresponds to an upward displacement of the latched member 520, which in turn disengages the locked state between the first door 300 and the second door 400, allowing the second door 400 to rotate relative to the first door 300. In this state, the latched member 520 may be pulled upward into the upper portion of the first door 300, such that an exposed portion of the latched member 520 outside the first door 300 becomes minimized.

Conversely, the second position of the moving member 510 corresponds to a downward displacement of the latched member 520, which disengages the locking state between the first door 300 and the second door 400. In this state, the latched member 520 may be pushed downward out of the upper portion of the first door 300, such that an exposed portion of the latched member 520 outside the first door 300 becomes maximized.

Figure 7:
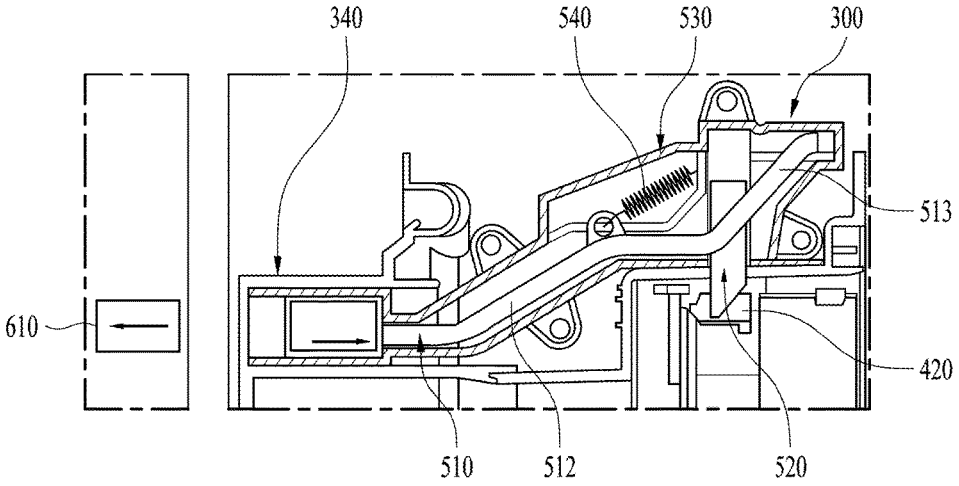
FIG. 7 is a diagram illustrating that a locking device restricts a rotation of a second door in a state that a first door is opened.

When the latched member 520 is in a downward displacement, it is connected to a latch receptor, such as latch portion 420 in FIGS. 6 and 7, of the second door 400. This connection therefore engages the locked state between the second door 400 to the first door 300 thereby restricting a rotation of the second door 400 with respect to the first door 300. Therefore, when the first door 300 is open so that the moving member 510 is in the second position causing the latched member 520 to be in a downward displacement, the second door 400 is engaged in the locked state to the first door 300.

Conversely, when the latched member 520 is in an upward displacement, it is not connected with the latch portion 420 of the second door 400. This allows the second door 400 to rotate freely relative to the first door 300. Therefore, when the first door 300 is closed so that the moving member 510 is in the first position causing the latched member 520 to be in an upward displacement, the second door 400 is disengaged from the locked state with the first door 300.

As such, the mechanism described above enables the refrigerator to maintain a locked state between the first door 300 and second door 400 when the first door 300 is in an open state, thus preventing the second door 400 from freely swinging open. Conversely, the mechanism allows the second door 400 to be freely opened when the first door 300 is in a closed state, allowing a user to access the sub-storage compartment by only opening the second door 400.

As described above, the moving member 510 is provided to move inside the first door 300. Moreover, the latched member 520 is provided to move inside the first door 300. Therefore, if a foaming or insulating agent is provided in the first door 300, then the first door 300 should nonetheless be configured to enable movement of the moving member 510 and the latched member 520.

To this end, the locking device 500 may include a housing 530, as shown in FIGS. 5-7. The housing 530 may be provided to receive the moving member 510 and the latched member 520 therein.

In the example of FIG. 5, the housing 530 includes a moving member guide 515 configured to guide movements of the moving member 510. In addition, the housing 530 may include a latched member guide 516 configured to guide movements of the latched member 520.

The housing 530 may be formed in such a manner that a plurality of housings are coupled to each other. For example, in FIG. 5, the housing 530 includes a first side housing 531 and a second side housing 532. The first side housing 531 and the second side housing 532 may be coupled to each other to form an inner space.

In some implementations, the housing 530 may include a first clamp 536 to which one end of the elastic member 540 is fixed, as shown in FIG. 5. The other end of the elastic member 540 may be fixed to a second clamp 514 that is provided in the moving member 510.

In the example of FIG. 5, the housing 530 includes a first penetrator 535 through which the latched member 520 passes. The first penetrator 535 may be configured such that the latched member 520 protrudes externally from the inside of the first door 300 by passing through the first penetrator 535.

In addition, the housing 530 may include a second penetrator 534. In some implementations, the second penetrator 534 may be formed at a rear portion of the magnetic substance 511. For example, the second penetrator 534 may be configured so as not to cover a rear portion of the magnetic substance 511.

The second penetrator 534 may be configured to enable a sufficiently strong magnetic force between the magnetic substance 610 of the main body and the magnetic substance 511 of the moving member 510. In some implementations, the second penetrator 534 may be configured so that the magnetic substance 610 of the main body and the magnetic substance 511 of the moving member 510 approach each other as closely as possible. In some implementations, the magnetic substances 610 and 511 may not actually come into direct contact, though implementations are not limited thereto. In the example of FIGS. 6 and 7, the magnetic substance 610 of the main body adjoins an outer surface of the door dike 340 and the magnetic substance 511 of the moving member 510 adjoins an inner surface of the door dike 340. As such, in a state in which the first door 300 is closed, the two magnetic substances 511 and 610 approach each other as close as possible by interposing the door dike 340 therebetween through the second penetrator 534.

The housing 530 may also include a magnetic guide 533 that guides movement of the magnetic substance 511 of the moving member 510, as shown in the example of FIG. 5. In some implementations, a width of the magnetic guide 533 along a forward-backward direction is greater than a corresponding width of the magnetic substance 511. Furthermore, in the example of FIG. 5, the second penetrator 534 is formed at the rear of the magnetic guide 533 towards the rear of the first door 300.

Hereinafter, an example of a mechanism of the locking device 500 will be described in detail with reference to FIGS. 6 and 7.

FIG. 6 illustrates an example of a state of the locking device 500 in which the second door 400 is free to rotate relative to the first door 300, and FIG. 7 illustrates an example of a state of the locking device 500 in which the second door 400 is restricted from rotating relative to the first door 300. For convenience of description, FIGS. 6 and 7 illustrate sectional views of the locking device 500 without the presence of a door deco 350.

As shown in the example of FIG. 6, the distance between the two magnetic substances 610 and 511 is minimized in a state in which the first door 300 is completely closed. As such, the two magnetic substances 610 and 511 generate maximum magnetic adhesive force to each other, with the door dike 340 interposed therebetween. This strong magnetic adhesive force causes the moving member 510 to move in a backward direction towards the magnetic substance 610 on the main body, away from the latched member 520. In addition, the resulting magnetic force may further enhance the sealing force of the first door 300 with the main body in a state that the first door 300 is closed.

As the moving member 510 is displaced in a backward direction towards a rear of the first door 300 due to the adhesive force between magnetic substances 610 and 511, this causes a corresponding upward displacement of the latched member 520. The upward displacement of the latched member 520 results in a shortening of the amount of protrusion of the latched member 520 from the first door 300. Therefore, the latched member 520 protrudes from the first door 300 by a smaller amount, and does not catch on the latch portion 420 provided in the second door 400. As a result, rotation of the second door 400 is allowed in a state that the first door 300 is closed.

As the first door 300 is rotated from the closed state to the opened state, the spaced distance between the two magnetic substances 610 and 511 increases, resulting in a weaker magnetic adhesive force. In some implementations, even in a state in which the first door 300 is opened by a small amount, the adhesive force between the two magnetic substances 610 and 511 may be weakened. For example, if the adhesive force between the two magnetic substances 610 and 511 is weaker than an elastic pulling force of the elastic member 540, then the moving member 510 moves in a forward direction away from the magnetic substance 511.

Conversely, as the moving member 510 is displaced in a forward direction towards a front of the first door 300 due to an elastic pulling force of the elastic member 540, this causes a corresponding downward displacement of the latched member 520. The downward displacement of the latched member 520 results in an increased protrusion of the latched member 520 from the first door 300. Therefore, the latched member 520 protrudes from the first door 300 by a larger amount, and is connected with the latch portion 420 provided in the second door 400. As a result, if the first door 300 is in an opened state, rotation of the second door 400 is restricted.

As described above, the locking device 500 may be configured to engage a locked state that restricts the second door 400 from being opened with respect to the first door 300 in a state in which the first door 300 is open. Conversely, the locking device 500 may disengage the locked state the first door 300 is closed, thus allowing a user to open the second door 400 when the first door 300 is closed. However, the locking device 500 does not restrict opening of the first door 300 in a state in which the second door 400 is opened. As such, even when the second door 400 is open, for example allowing a user to access a sub-storage compartment, the user may additionally open the first door 300, for example to access the main storage compartment. In this case, there is no restriction on the user closing the second door 400 after closing the first door 300. However, there may also be scenarios in which the user closes the second door 400 in a state in which the first door 300 is in an open state. In such scenarios, as described above, the open state of the first door 300 causes the latched member 520 to be in a protruded state. Therefore, in this state, a problem may occur when the second door 400 is closed, causing the second door 400 to collide with the protruded latched member 520.

To address this problem, in some implementations, the latched member 520 may be provided with an inclined surface 522 at an end thereof. The inclined surface 522 may enable the second door 400 to become fully closed relative to the first door 300 even when the latched member 520 protrudes in a downward direction in an open state of the first door 300. In the example of FIG. 5, the inclined surface 522 is a portion of the latched member 520 that is inserted into the latch portion 420. The inclined surface 522 may include an inclined surface that faces towards the front of the second door 400. As the second door 400 rotates in a closing motion relative to the first door 300, the second door 400 comes in contact with the inclined surface 522 and pushes the inclined surface 522 of the latched member 520 in an upward direction. The upward displacement of the latched member 520 allows the second door 400 to become fully closed relative to the first door 300. After this closure, the latched member 520 returns to the downward displacement inside the latch portion 420 due to the sustained pulling force of the elastic member 540, thus engaging the locked state between the first door 300 and the second door 400 while the first door 300 remains open.

The inclined surface 522 thus enables the user to close the second door 400 even in a state in which the first door 300 is open. Therefore, even in a scenario in which the user opens the first door 300 and also opens the second door 400 relative to the first door 300, the locking device 500 may be configured to enable the user to close the second door 400 relative to the opened first door 300 and engage the locked state between the two doors while the first door 300 remains open.

In some implementations, for example in a refrigerator having French-style double-sided doors, such as a French-type refrigerator, that fully open the refrigerator compartment, a pillar structure may be provided that seals a middle portion of the refrigerator compartment. The pillar may be applied to the refrigerator of which a single storage compartment is opened by French-style double-sided doors. For example, the pillar may be provided to be tightly adhered to French-style double-sided doors in the middle of both sides of the storage compartment. The pillar may be connected to any one of the doors and rotated together with the door if the door is opened. The pillar may compart both sides of the storage compartment at the front of the storage compartment if the door is closed. In some implementations, the pillar may not include an insulation wall computing the storage compartment to both sides. Such a pillar structure may be provided, for example, in a French type refrigerator.

In some implementations, the pillar may be rotatably provided at the left door. Therefore, if the right door is closed, the pillar may be configured to unfold and be sealed with the right door. Implementations are not limited thereto, however, and the pillar structure relative to the right door and the left door may be reversed with respect to each other.

In the example of FIG. 5, a pillar bracket 600 may include a magnetic substance configured to unfold the pillar if the right door is closed, and to fold the pillar if the right door is opened. The pillar bracket 600 may include a magnetic housing 605 surrounding the magnetic substance.

In some implementations, as shown in FIG. 5, the magnetic substance of the pillar bracket 600 may be the magnetic substance 610 of the main body. The magnetic substance 610 may be configured to be adaptively displaced based on whether first door 300, which may be a right door, is closed. For example, if the first door 300 is closed, the magnetic substance 610 of the main body moves in a forward direction towards a front of the first door 300 together with the magnetic housing 605. As such, the magnetic substance 610 of the main body moves in a forward direction through attraction with the magnetic substance 511 provided on the locking device 500 in the first door 300. Conversely, the magnetic substance 511 of the locking device 500 moves in a backward direction when the first door 300 is opened. That is, if the first door 300 is closed relative to the main body, then the two magnetic substances 610 and 511 generate sufficient magnetic attraction to pull each other together from opposite directions.

Backward movement of the magnetic substance 511 of the locking device 500 corresponds to establishing a locking, and forward movement of the magnetic substance 610 of the main body corresponds to the pillar being unfolded through the pillar bracket 600.

In some implementations, if the first door 300 is open, then the distance between the magnetic substance 610 of the main body and the magnetic substance 511 of the locking device 500 is increased, thereby weakening the magnetic attraction. In this scenario, the magnetic substance 610 of the main body may be pulled in a backward direction, for example by an elastic member provided in the pillar bracket 600. As such, the elastic pulling force of the elastic member may overcome the force of magnetic attraction between magnetic substances 511 and 610. Conversely, the magnetic substance 511 of the locking device 500 is pulled in a forward direction by the elastic member 540.

Backward movement of the magnetic substance 610 of the main body corresponds to the pillar being folded through the pillar bracket 600. Moreover, forward movement of the magnetic substance 511 of the locking device 500 corresponds to establishing the locking.

As such, implementations described herein provide a locking device and a pillar structure that are configured to operate simultaneously through two magnetic substances. Also, the locking device may be provided substantially or entirely inside the first door 300, without any extraneously protruding elements between the first door 300 and the main body or cabinet of the refrigerator. As an example of such an implementation, the examples described above provide a non-contact magnetic attractive force between two magnetic substances provided on the first door 300 and the main body, respectively. In such implementations, the locking device may detect whether the first door 300 is in an open or closed state relative to the main body of the refrigerator using a non-contact-based attraction between magnetic substances.

As a result, the locking device and the pillar structure may provide reliable and fast-reaction performance. Furthermore, the components of the locking device and the pillar structure elements may operate substantially in a non-contact manner, thereby mitigating problems such as friction or abrasion between components.

What is claimed is:

1. A home appliance comprising:

a main body having a storage compartment defined therein;

a first door hingedly coupled to the main body and configured to open and close the storage compartment;

a second door rotatably provided relative to the first door and comprising a latch receptor; and a locking device that is disposed in the first door and that comprises a magnetic component and a latch member, the locking device configured to:

in a state in which the first door closes the storage compartment of the main body and the magnetic component is separated from the main body by a first distance, disengage the latch member from the latch receptor of the second door; and in a state in which the first door opens the storage compartment of the main body and the magnetic component is separated from the main body by greater than the first distance, engage the latch member into the latch receptor of the second door.

2. The home appliance according to claim 1, wherein the locking device further comprises a moving member that connects the magnetic component with the latch member, the moving member configured to:

in the state in which the first door closes the storage compartment of the main body and the magnetic component is separated from the main body by the first distance, apply a first displacement force to the latch member that disengages the latch member from the latch receptor of the second door, and in the state in which the first door opens the storage compartment of the main body and the magnetic component is separated from the main body by greater than the first distance, apply a second displacement force to the latch member that engages the latch member into the latch receptor of the second door.

3. The home appliance according to claim 2, wherein the locking device further comprises an elastic member coupled to the moving member and configured to:

apply, to the moving member, an elastic restoring force that causes the moving member to exert the second displacement force to the latch member that engages the latch member into the latch receptor of the second door.

4. The home appliance according to claim 3, wherein:

in the state in which the first door closes the storage compartment of the main body and the magnetic component is separated from the main body by the first distance:

a magnetic attractive force between the magnetic component and the main body displaces the moving member in a first direction that is opposite to a second direction in which the moving member is pulled by the elastic restoring force applied by the elastic member; and in the state in which the first door opens the storage compartment of the main body and the magnetic component is separated from the main body by the second distance greater than the first distance:

the elastic restoring force applied by the elastic member on the moving member displaces the moving member in the second direction that is opposite to the first direction in which the moving member is pulled by the magnetic attractive force between the magnetic component and the main body.

5. The home appliance according to claim 1, wherein:

the second door comprises a sidewall portion in which the latch receptor is disposed, the first door further comprises a door frame that defines an opening through the first door, and at least a part of the sidewall portion of the second door is provided in a partially inserted position within the opening of the door frame.

6. The home appliance according to claim 5, wherein:

the locking device in the first door is configured to engage the latch member with the latch receptor of the second door by extending the latch member to protrude outward from the door frame of the first door and become inserted into the latch receptor of the second door, and the locking device in the first door is configured to disengage the latch member from the latch receptor of the second door by retracting the latch member within the door frame of the first door and become removed from within the latch receptor of the second door.

7. The home appliance according to claim 1, wherein the main body comprises a magnetic portion configured to generate the magnetic attractive force with the magnetic component of the locking device, wherein at least one of the magnetic portion of the main body or the magnetic component of the moving member is a magnet.

8. The home appliance according to claim 2, wherein the locking device further comprises a displacement transfer member provided between the moving member and the latch member, the displacement transfer member configured to:

based on a displacement of the moving member, apply a corresponding displacement to the latch member.

9. The home appliance according to claim 8, wherein the displacement transfer member comprises:

a first inclined portion provided in the moving member; and a second inclined portion provided in the latch member, the second inclined portion configured to slide relative to the first inclined portion.

10. The home appliance according to claim 9, wherein the second inclined portion comprises an inclined hole through which the first inclined portion is configured to be inserted at an angle.

11. The home appliance according to claim 10, wherein:

the second inclined portion is configured to slide relative to the first inclined portion according to the displacement of the moving member, and the latch member is configured to be displaced along a vertical direction that is perpendicular to a direction along which the moving member is displaced.

12. The home appliance according to claim 1, wherein the locking device comprises a housing configured to receive the moving member and the latch member therein, the housing configured to guide a movement of the moving member and a movement of the latch member.

13. The home appliance according to claim 12, wherein the housing comprises a first penetrator through which at least a part of the latch member protrudes from or retracts within.

14. The home appliance according to claim 13, wherein the housing further comprises a second penetrator configured to restrict the magnetic portion of the main body from approaching the magnetic component of the moving member by less than a minimum distance.

15. The home appliance according to claim 1, wherein the latch member comprises an inclined surface formed at an end portion of the latch member that is inserted into the latch receptor, the inclined surface facing towards a front of the first door and having a slope that recedes towards a rear of the first door along a downward direction.

16. The home appliance according to claim 1, wherein:

the main body further comprise a pillar bracket, and the magnetic portion of the main body is provided in the pillar bracket.

17. The home appliance according to claim 1, wherein the locking device is provided on a first side end portion of the first door that is opposite to a second side end portion of the first door on which the first door is hingedly coupled to the main body.

18. The home appliance according to claim 1, wherein the home appliance is a refrigerator.

19. A home appliance comprising:

a main body having a storage compartment defined therein and a magnetic portion configured to generate a magnetic attractive force;

a first door hingedly coupled to the main body and configured to open and close the storage compartment;

a second door rotatably provided relative to the first door; and a locking device disposed in the first door and configured to:

in a state in which the first door opens the storage compartment of the main body, engage a locked state between the first door and the second door that restricts an opening operation of the second door relative to the first door; and in a state in which the first door closes the storage compartment of the main body, disengage the locked state between the first door and the second door by the magnetic attractive force of the magnetic portion.

20. The home appliance according to claim 19, wherein the locking device further comprises a magnetic component and is configured to:

engage the locked state between the first door and the second door based on the magnetic component and the main body being separated by a first distance, and disengage the locked state between the first door and the second door based on the magnetic component and the main body being separated by less than the first distance.

21. The home appliance according to claim 20, wherein:

the second door comprises a latch receptor; and the locking device in the first door further comprises a latch member, the locking device further configured to:

insert the latch member into the latch receptor of the second door in the state in which the first door opens the storage compartment of the main body; and retract the latch member out of the latch receptor of the second door in the state in which the first door closes the storage compartment of the main body.

22. The home appliance according to claim 21, wherein:

the locking device in the first door further comprises a moving member, and the locking device is further configured to:

in the state in which the first door opens the storage compartment of the main body, displace the moving member in a first direction towards a front of the first door such that the moving member applies a first force on the latch member inserting the latch member into the latch receptor of the second door; and in the state in which the first door closes the storage compartment of the main body, displace the moving member in a second direction towards a rear of the first door such that moving member applies a second force on the latch member retracting the latch member out of the latch receptor of the second door.

23. The home appliance according to claim 22, wherein the locking device further comprises a housing configured to receive the moving member and the latch member therein, the housing being fully encased within the first door.

24. The home appliance according to claim 23, wherein the housing is arranged inside the front door, within an upper side of the first door.

25. The home appliance according to claim 21, wherein the latch member comprises an end portion that is selectively exposed outside of the first door, the exposed part of the end portion being reduced by a rearward displacement of the moving member and being increased by a forward displacement of the moving member.

26. The home appliance according to claim 21, wherein the locking device further comprises a displacement transfer member provided between the moving member and the latch member, the displacement transfer member configured to:

based on a displacement of the moving member, apply a corresponding displacement to the latch member.

27. The home appliance according to claim 21, wherein the moving member comprises the magnetic component provided at an end portion of the moving member.

28. The home appliance according to claim 27, wherein the locking device further comprises an elastic member configured to apply an elastic restoring force to the moving member in a first direction that is opposite to a second direction in which the moving member is pulled by a magnetic attraction between the magnetic component and the main body.

29. The home appliance according to claim 28, wherein:

the main body comprises:

a pillar, and wherein the magnetic portion is configured to generate the magnetic attraction with the magnetic component of the locking device, the magnetic portion configured to move in a rearward direction and fold the pillar in the state in which the first door opens the storage compartment of the main body.

30. A home appliance comprising:

a main body having a storage compartment defined therein, the main body comprising a magnetic portion;

a first door hingedly coupled to the main body and configured to open and close the storage compartment and including a door frame with an opening;

a second door rotatably provided relative to the first door and configured to open and close the opening, the second door comprising a receptor; and a locking device disposed in the first door, the locking device configured to:

in a state in which the first door opens the storage compartment of the main body, a portion of the locking device protrudes from the door frame and is thereby inserted into the receptor; and while the first door closes the storage compartment of the main body, the portion of the locking device is withdrawn from the receptor by a variation of a magnetic force between the magnetic portion of the main body and the locking device of the first door.

* * * * *